United States Patent [19]

Huang

[11] Patent Number: 4,807,893

[45] Date of Patent: Feb. 28, 1989

[54] ROLLER SKATE

[76] Inventor: Chuan H. Huang, No. 13, La. 2, Chang Shou St., Shu Lin Chen, Taipei Hsien, Taiwan

[21] Appl. No.: 170,893

[22] Filed: Mar. 21, 1988

[51] Int. Cl.[4] ..... A63C 17/14

[52] U.S. Cl. ..... 280/11.2; 188/5

[58] Field of Search ..... 280/11.1 R, 11.19, 11.2, 280/11.22, 11.23, 11.24, 11.25, 11.26, 87.04 R, 87.04 A; 188/4 R, 5, 29, 57, 74, 177

[56] References Cited

U.S. PATENT DOCUMENTS

| | | | |
|---|---|---|---|
| 225,361 | 3/1880 | French | 280/11.2 |
| 1,402,010 | 1/1922 | Ormiston | 280/11.2 |
| 2,173,716 | 9/1939 | Gurleay | 280/11.2 |
| 2,179,592 | 11/1939 | Goettie | 280/11.2 |
| 2,901,259 | 8/1959 | Williams | 280/11.2 |
| 3,749,413 | 7/1973 | Nicolson | 280/11.2 |
| 4,570,955 | 2/1985 | Winkler et al. | 280/11.2 |
| 4,602,801 | 8/1986 | Vincent | 280/11.115 |

FOREIGN PATENT DOCUMENTS

| | | | |
|---|---|---|---|
| 129196 | 3/1949 | Netherlands | 280/11.2 |
| 132639 | 7/1929 | Switzerland | 280/11.25 |
| 894846 | 4/1962 | United Kingdom | 280/11.2 |

*Primary Examiner*—Charles A. Marmor
*Assistant Examiner*—Richard Camby
*Attorney, Agent, or Firm*—Barnes & Thornburg

[57] ABSTRACT

A roller skate comprises a pair of adjacent rollers which are mounted on a shaft which in turn is mounted on two bracket plates extending downward from an intermediate portion of a pedal plate. A lever is pivotally mounted on the bracket plates above said rollers. The lever has an arched portion which extends over the rollers and has a distal end extending adjacent to the front side of the roller. The lever then extends rearward and holds a brake block substantially below the heel portion of the pedal plate. A spring is employed between the pedal plate and the lever to push the lever against a projection formed on one the bracket so as to prevent the lever from swinging. The skate is put in the braking position when the heel portion is depressed. The skate may further include front rollers substantially below the toe portion of the skate and a front brake block substantially at the front of the toe portion.

10 Claims, 4 Drawing Sheets

ROLLER SKATE

BACKGROUND OF THE INVENTION

This invention relates to a roller skate and particularly to a roller skate which includes two rollers mounted coaxially on two brackets extending downward substantially from the central portion of an elongated pedal plate, the rollers being close to one another but with a clearance maintained therebetween for independent rotation, and which includes a simple brake mechanism having a brake block at the rear side of the rollers to rest on the ground when the toe section is raised from its depressed position and then the heel section of the skate is depressed, the brake block progressively braking the skate. Most conventional roller skates have two pairs of wheels, one of the pairs being mounted on a front axis and the other being mounted on a rear axis and the rollers in each pairs being spaced apart a substantial distance. To propel these roller skates, the skater has to raise the rear pair of rollers and rest the front pair of rollers on the skating floor. Since the front rollers of such roller skate are spaced apart, when revolving, the center of rotation changes along a sprial path, thereby causing difficulties in controlling the point of the application of torque, especially to a beginner.

The braking mechanism of a roller skate is also an important means to control the skating operation. Various braking mechanisms have existed in the art. Some examples of the braking mechanisms are disclosed in U.S. Pat. No. 2,901,259, Swiss Pat. No. 132,639, Dutch Pat. No. 129,196, and British Pat. No. 894,846. In these braking mechanisms, the brake members are placed in the toe sections of the roller skates, and the braking is performed by depressing the toe sections of the skates. Such a braking action is disadvantageous since the depression is accomplished when the skater slants his body slightly forward to move his center of gravity to the front portion of his body. In this circumstance, due to the inertia phenomenon, the skater may loose his balance and fall, although the roller skate is topped. Accordingly, with these braking mechanisms, the skaters must carefully control themselves while braking.

U.S. Pat. No. 2,225,361 discloses a roller skate which has a swinging brake-shoe arranged at the heel of the skate to produce a braking action when the projection of the brake-shoe engages a cushion member to prevent it from swinging. While the braking action of this device is achieved when the toe section is raised, it is still unsatisfactory since, when the toe section is raised, only rear wheels remain to keep the balance of the skater during braking.

U.S. Pat. No. 4,602,801 discloses a roller skate which has a control device that can be put in a braking position when the heel section of the skate is depressed. This roller skate includes a single roller on each of three parallel axes and the control device is safe and progressive. The construction of the skate, however, is rather complicated.

FIGS. 6 and 7 show a roller skate which was previously disclosed in an abandoned application of the applicant of the present invention.

SUMMARY OF THE INVENTION

An object of the invention is to provide an improved roller skate which is simple in construction and still allows a skater to easily make a good balance control when both propelling and braking the skate.

According to the present invention, a roller skate comprises an elongated pedal plate having two spaced apart downward bracket plates extending from a portion between the toe portion and the heel portion thereof, two first rollers mounted on the bracket plates for rotation about a horizontal axis, the rollers being substantially close to one another with a clearance maintained therebetween for independent rotation, a lever member between the pedal plate and the rollers, mounted on the bracket plates for pivotal movement about an axis above said horizontal axis of the first rollers, the lever having an arched portion which extends over the roller and has a distal end near the front side of the first roller, the lever extending rearwardly and holding substantially below the heel portion a brake block to rest on the ground when in the braking position, the arched portion holding a brake plate to be in contact with the first roller when in the braking position, means formed on the pedal plate for engaging said arched portion in order to prevent the lever from swinging, and a spring member placed between the pedal plate and the arched portion for urging the arched portion to engage with the engaging means.

The skate further includes two second rollers in front of the first roller to contact the ground when the toe portion is slanted downward with respect to a horizontal plane, and a front brake block at the front of the toe portion. The skate can be put in a braking position when the heel portion is depressed.

The exemplary preferred embodiment will be described in detail with reference to the following drawings, in which:

DETAILED DESCRIPTION OF THE PREFERRED EMBODIMENT

Figure 1:
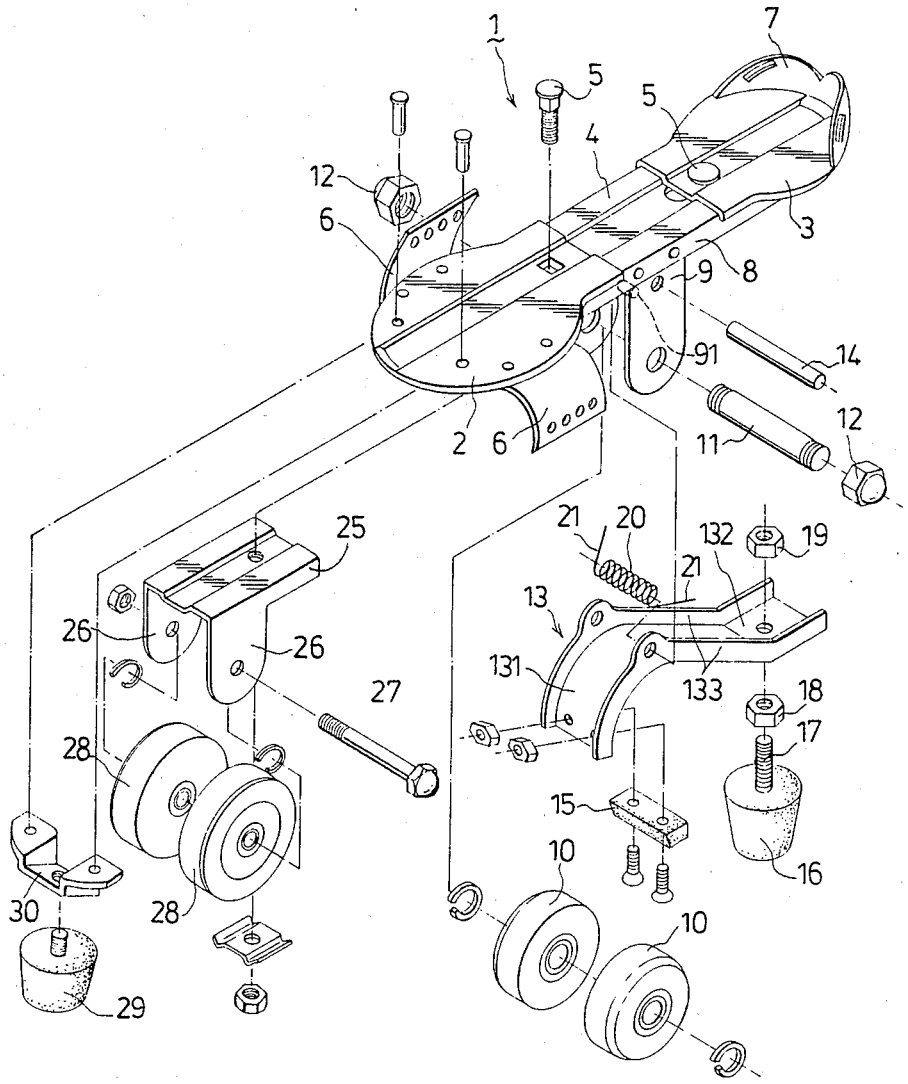
FIG. 1 is an exploded view of a first embodiment of the present invention.
Figure 2:
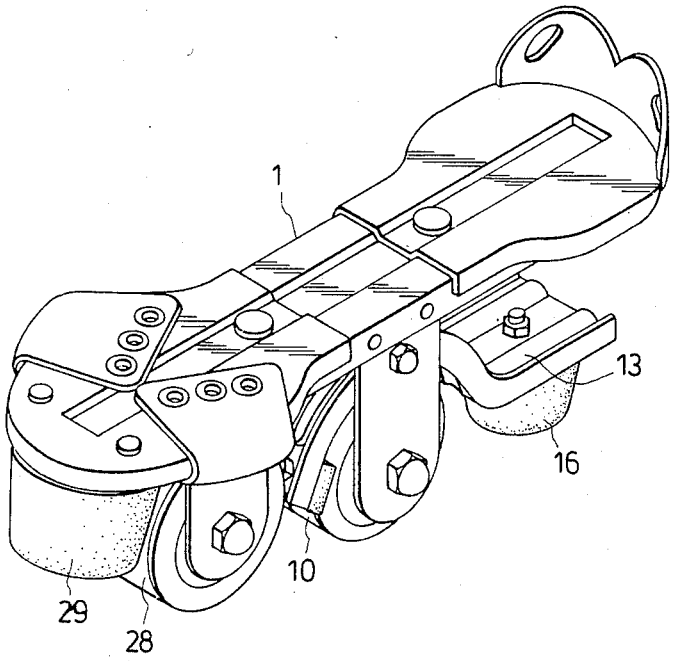
FIG. 2 is a perspective view of the first embodiment.

Referring to FIGS. 1 and 2, a first preferred embodiment of the invention is shown, including an elongated pedal plate 1 which includes a toe section 2 and a heel section 3 which are fixed releaseably to an intermediate section 4. The length of the pedal plate is adjustable by moving the front section and the rear section relative to the intermediate portion and fastening them with screws 5. Attachment straps 6 and a strap 7 are attached to the pedel plate 1.

The pedal plate 1 has two longitudinal edge flanges 8 extending downward and two downward bracket plates 9 are integrally connected to the edge flanges 8 of the intermediate portion 4. Two rollers 10 are closely mounted rotatably on a shaft 11 with a clearance therebetween for permitting independent rotation, and the shaft 11 is attached to the brakets 9 with locking nuts 12 which are connected threadedly thereto.

Between the pedal plate 1 and the rollers 10 is provided a lever plate 13 which has an arched portion 131, a planer portion 132 and upward flanges 133. The flanges 133 are pivotally connected respectively to the bracket plates 9 with a pivot axis 14 above the shaft 11. The arched portion 131 extends over the rollers 10 and has an end holding a cushion member or a brake 15 adjacent to the front side of the rollers 10. The arched portion 131 extends to the rear side of the rollers 10 and then is connected to the planer portion 132 substantially extending below the heel portion 3. A truncated cone-shaped brake block 16 is attached to the planer portion 132 by means of nuts 18 and 19 and a screw rod 17 which is integrally connected to the brake block 16. The bottom side of the brake block 16 is higher than that of the rollers 10 when the pedal plate 1 is horizontal, and the height of the brake block 16 can be adjusted. A projection 91 is formed on one of the bracket plate 9 in order to engage with the arched portion 131 so as to prevent the lever 13 from swinging.

A helical spring 20 is sleeved on the axis 14 and has two end portions 21 respectively abutting the bottom side of the pedal plate 1 and the upper side of the arched portion 131 to push the arched portion 131 against projection 9, thereby preventing the lever from swinging.

A bracket 25 is attached to the toe section 2 and has two downward flanges 26 on which is mounted a shaft 27 carrying two front rollers 28 which are also adjacent to one another with a clearance maintained therebetween for independent rotation. The front rollers 28 contact the ground when the toe portion 2 is slightly depressed. A front brake block 29 is fixed to a mounting plate 30 which is fixed to the front side of the toe section 2.

Figure 3:
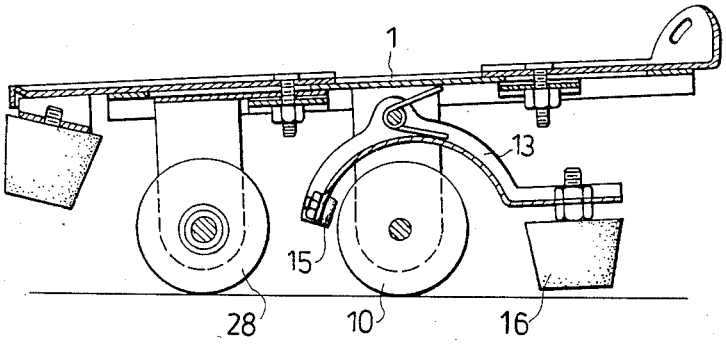
FIG. 3 is a sectional view of the first embodiment in a position in which the roller skate is propelled and the toe portion is depressed.
Figure 4:
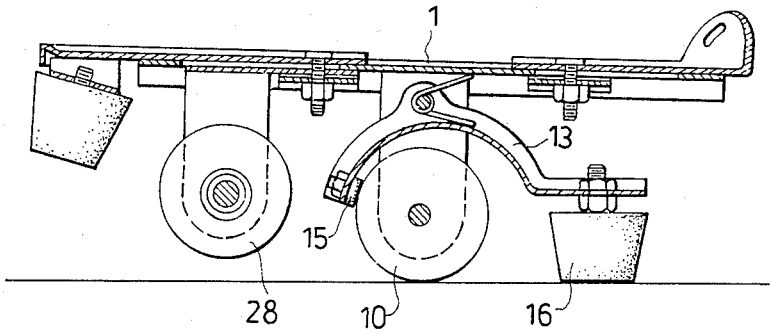
FIG. 4 is a sectional view of the first embodiment in a position in which the heel portion is depressed.
Figure 5:
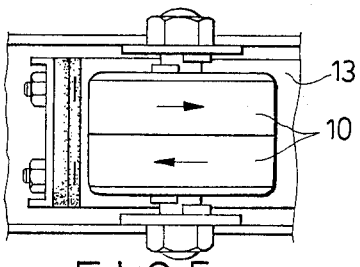
FIG. 5 is a schematic view showing that two adjacent rollers rotate in opposite direction.
Figure 6:
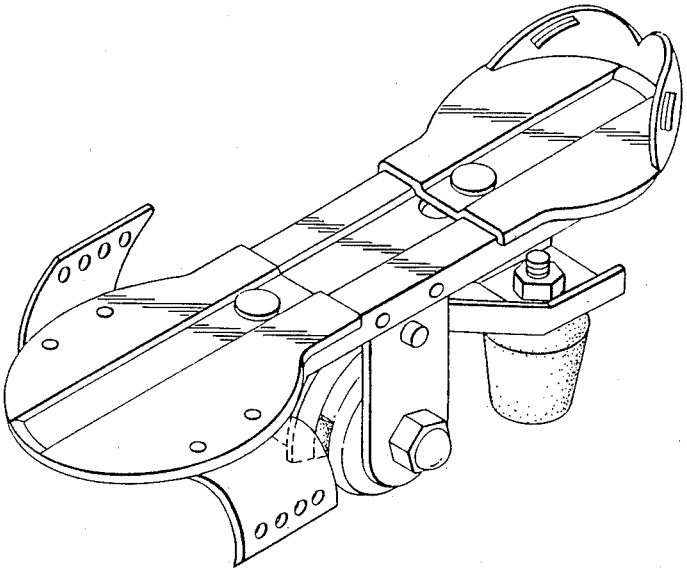
FIG. 6 (PRIOR ART)
FIG. 6 is a perspective view of a skate roller in the prior art.
Figure 7:
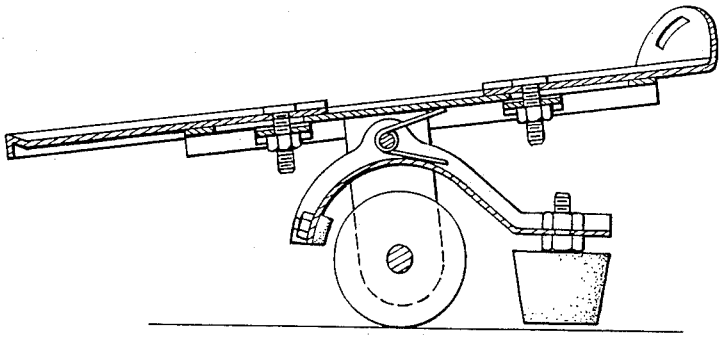
FIG. 7 (PRIOR ART)
FIG. 7 is a sectional view of the skate roller of FIG. 6.

In operation, the toe portion 2 of the skate is depressed slightly so that rollers 10 and front rollers 28 are in rolling contact with the ground and the brake block 16 is raised as shown in FIG. 3. In this situation, the brake member 15 and the brake block 16 are out of their braking positions, that is to say, they do not abut with the rollers 10 and the ground respectively. When the skater depresses the heel portion as shown in FIG. 4, the spring member 20 is compressed, the rollers 10 abuts with the brake member 15, and the brake block 16 rests on the ground, thereby braking the skate. It can be noted that the braking does not require depression of the toe portion. In making a revolving action with this skate, the skater may use front rollers 28 or both sets of rollers 28 and 10. Since the rollers 28 or 10 are close to one another, the degree of change of the position of the axis of rotation is less than that of rollers which are spaced apart. It can be noted that, when revolving, adjacent rollers 10 or 28 rotate in opposite directions, as shown in FIG. 5.

With the invention thus explained, it is apparent that various modification and variations can be made without departing from the scope of the invention. It is intended that the invention be limited as indicated in the appended claims.

What I claim is:

1. A roller skate comprising:

an elongated pedal plate having a toe portion, a heel portion, two spaced apart downward bracket plates extending from an intermediate portion between said toe portion and said heel portion;

two first rollers mounted on said bracket plates for rotation about a horizontal axis, said rollers being substantially close to one another with a clearance maintained therebetween for independent rotation, said rollers being situated to act as a fulcrum to permit said pedal plate to tilt forwardly and rearwardly about said horizontal axis;

a lever member between said pedal plate and said rollers, mounted on said bracket plates for pivotal movement about an axis above said horizontal axis of said first rollers, said lever having an arched portion which extends over said rollers and has a distal end near a front side of said first rollers, said lever extending rearwardly and holding substantially below said heel portion a brake block which will rest on the ground when in a braking position, said distal end of said arched portion being able to abut with said first rollers when in said braking position;

means formed on one of said bracket plates for engaging said arched portion in order to prevent said lever from swinging;

a spring member placed between said pedal plate and said arched portion for urging said arched portion to engage with said engaging means; and two second rollers mounted on said pedal plate in front of said first rollers, said second rollers being substantially close to one another with a clearance maintained therebetween for independent rotation, said second rollers contacting the ground only when said toe portion is tilted forwardly with respect to said horizontal axis.

2. A roller skate as claimed in claim 1, wherein said spring member is a helical spring sleeved on said axis of said lever and having two end portions respectively engaging said pedal plate and said lever.

3. A roller skate as claimed in claim 1, wherein said brake block is a truncated cone-shaped block which has a screw rod extending upward, said screw rod adjustably attached to said lever.

4. A roller skate as claimed in claim 1, further comprising a front brake block attached to said pedal plate and extending downwardly in front of said front rollers.

5. A roller skate as claimed in claim 1, wherein said distal end of said arched portion has a brake plate attached thereto to contact said first rollers.

6. A roller skate comprising:

an elongated pedal plate having a toe portion, a heel portion, and an intermediate portion between said toe portion and said heel portion;

a first pair of rollers mounted for rotation about a first horizontal axis below said intermediate portion of the pedal plate, the rollers being situated for contact with the ground to act as a fulcrum to permit said pedal plate to tilt forwardly and rearwardly about the first horizontal axis;

a second pair of rollers mounted for rotation about a second horizontal axis below said toe portion in front of said first axis, said second rollers contacting the ground only when said toe portion is tilted forwardly about said first horizontal axis; and a lever member mounted for pivotal movement relative to the pedal plate and having a front end near said first pair of rollers and a rear end including a brake block situated below said heel portion, the brake block contacting the ground only when said pedal plate is tilted rearwardly, the contact of the brake block with the ground causing the lever to pivot such that the front end of the lever contacts the first pair of rollers.

7. The roller skate of claim 6 further comprising two spaced apart bracket plates extending downwardly from said intermediate portion, the first pair of rollers being mounted for independent rotation to the bracket plates.

8. The roller skate of claim 6 wherein said lever comprises an arched portion which extends over said first pair of rollers, said lever front end being situated near a front side of said first pair of rollers.

9. The roller skate of claim 6 further comprising spring means in contact with the lever to bias the lever front end away from contact with the first pair of rollers.

10. A roller skate comprising:

an elongated pedal plate having a toe portion, a heel portion, an intermediate portion between said toe portion and said heel portion, and two spaced apart bracket plates extending downwardly from said intermediate portion;

a first pair of rollers mounted to the bracket plates for independent rotation about a first horizontal axis below said intermediate portion of the pedal plate, the rollers being situated for contact with the ground to act as a fulcrum to permit said pedal plate to tilt forwardly and rearwardly about the first horizontal axis;

a second pair of rollers mounted for rotation about a second horizontal axis below said toe portion in front of said first axis, said second rollers contacting the ground only when said toe portion is tilted forwardly about said first horizontal axis to an inclined position;

a lever member mounted for pivotal movement relative to the pedal plate having an arched portion which extends over said first pair of rollers, having a front end situated near a front side of said first pair of rollers, and a rear end including a brake block situated below said heel portion, the brake block contacting the ground only when said pedal plate is tilted rearwardly to an inclined position, the contact of the brake block with the ground causing the lever to pivot such that the front end of the lever contacts the first pair of rollers; and spring means in contact with the lever to bias the lever front end away from contact with the first pair of rollers.

* * * * *